United States Patent [19]

Edelson

[11] Patent Number: 4,482,893

[45] Date of Patent: Nov. 13, 1984

[54] CATHODE RAY TUBE DISPLAY SYSTEM WITH MINIMIZED DISTORTION FROM ALIASING

[76] Inventor: Steven D. Edelson, 7 Sears Rd., Wayland, Mass. 01778

[21] Appl. No.: 350,195

[22] Filed: Feb. 19, 1982

[51] Int. Cl.[3] ..... G09G 1/16

[52] U.S. Cl. ..... 340/723; 340/778; 340/747

[58] Field of Search ..... 340/734, 720, 723, 725, 340/747, 721, 728

[56] References Cited

U.S. PATENT DOCUMENTS

| | | | |
|---|---|---|---|
| 4,205,389 | 5/1980 | Heartz | 340/747 |
| 4,208,719 | 6/1980 | Lotz et al. | 340/728 |
| 4,354,184 | 10/1982 | Woborschil | 340/725 |
| 4,384,286 | 5/1983 | DiToro | 340/734 |
| 4,396,988 | 8/1983 | Fitzgerald, Jr. | 340/720 |

*Primary Examiner*—Marshall M. Curtis
*Attorney, Agent, or Firm*—Lane, Aitken & Kananen

[57] ABSTRACT

In a cathode ray tube display system in which objects to be displayed are represented by digital signals, a technique is employed to reduce distortion caused by aliasing. The objects to be displayed are represented in a memory by transition specifications which represent the object to be displayed by defining the character of the edges of the object to be displayed. From the transition specifications, a video signal is generated and applied to the cathode ray tube display device to display the object represented by the stored transition specifications. The circuitry generating the video signal causes the video to change in steps across the width of a transition from the brightness prior to the edge to the final brightness of the other side of the edge with the width of the transition varying in accordance with the slope that the edge makes with the raster scan line.

13 Claims, 21 Drawing Figures

CATHODE RAY TUBE DISPLAY SYSTEM WITH MINIMIZED DISTORTION FROM ALIASING

This invention relates to cathode ray display systems for displaying geometrical shapes, lines, and characters in response to digitally coded input commands and, more particularly, to such a cathode ray tube display system provided with means to minimize distortion in such displays caused by aliasing.

A typical high resolution cathode ray tube display device responding to digital commands to generate geometric displays employs picture elements (pixels) to define areas of the screen. These pixels are small areas of the screen defined by subdividing the scan lines into small parts along arbitrary boundaries. The display is created by specifying which of the pixels are to be illuminated and to what intensity or color. Pixels are indivisible and form the smallest unit of the display. Since a diagonal line or edge of a geometric object must be expressed in pixels, the edge will appear as a stairstep where a jump from one pixel to the next is made. This stairstep distortion is attributed to aliasing, which is a term for signal distortion caused by sampling at too widely spaced intervals. One cure for distortion caused by aliasing is to average the response or several pixels at the edges of objects or lines to provide shading. However, this shading to simulate the edge falling between pixels must also be expressed in terms of whole pixels and the shading cannot be finer than the pixels themselves. The result is a fuzzy, poorly defined image. In addition, since such correction is computation intensive, a more common technique for lessening the aliasing and distortion is to divide the screen into finer and finer pixels. High resolution CRT display devices are currently composed of 512×512 pixels or 1,024×1,024 pixels. These higher resolutions exceed both the ability of the cathode ray tube to display the information and the ability of the user to distinguish single pixel entities. The geometric growth of the pixels required to accurately depict an image without visible aliasing and distortion requires the graphic processor to keep track of a very large number of pixels for even a simple object. Another disadvantage of such high resolution is that the displays require more sophisticated cathode ray tubes and the display system is incompatible with video recording and hard copy devices which are normally set up for the NSTS standard of a 525 line scan.

The object of this invention is to provide a visually superior display by providing circuitry to control the positioning and gradation of colors and intensity in detail unobtainable by comparable pixel display systems using comparable cathode ray tubes or hard copy devices. This objective is obtained by storing and displaying detailed information about transitions in intensity and color required in the video signal to display the desired objects. These transitions are defined in much greater detail than the resolution provided by the logical space usually required by one pixel. The invention exploits the fact that the cathode ray tube display is not a matrix of square areas as it is considered to be in a pixel display device, but rather can be considered a set of continuous horizontal lines with no divisions. This is true even though color cathode ray tubes are normally composed of discreet phosphor dots since in a pixel display device, the pixels are not related specifically to the color dots of the color cathode ray tube. Moreover, typical accessories such as hard copy and projection systems make use of multiple monochrome images which have no phosphor patterns. The invention takes advantage of the fact that the cathode ray tube has the ability to display continuous gradations in brightness and color and the invention exploits the fact that the graphic information needed to define only edges of the objects constitutes only small areas of the screen with the majority of the screen being a background color or a homogeneous color of an object.

The invention enables objects to be displayed overlapping one another with automatic removal of hidden lines without excessive complexity and these hidden lines and surfaces are automatically restored when the obscuring objects are removed from the display.

Another object of the invention is the provision or the display of blinking objects. In accordance with a unique aspect of the invention, the edges, surfaces and lines, which are hidden behind the blinking objects during the intervals when the blinking objects are present or "on", are visible in the alternate intervals when the blinking objects are "off".

In accordance with the invention, each object to be displayed is defined as sets of scan line transitions. A transition is defined as the change in brightness and color where the raster scan crosses over the edge of an object. The details of each transition are stored in memory as a transition specification. From these transition specifications, a video signal is generated and applied to the cathode ray tube display device to display the object represented by the stored transition specifications. The circuitry generating the video signals causes the video to change in steps across the width of the transition from the intensity prior to the edge to the final intensity at the other side of the edge with the width of the transition varying in accordance with the slope that the edge makes with the raster scan line. The goal of the system is to generate a video signal simulating as closely as possible the signal that would be generated by a video camera aimed at real objects with the same shape and colors as those being created. Because the transitions are represented in this manner, and also because the start of the transition can be controlled much more precisely than when objects are defined in terms of pixel elements, the object is displayed with distortion caused by aliasing substantially reduced.

Further objects and advantages of the present invention will become readily apparent from the following detailed description of the invention when considered in conjunction with the accompanying drawings.

DESCRIPTION OF A PREFERRED EMBODIMENT

Figure 1:
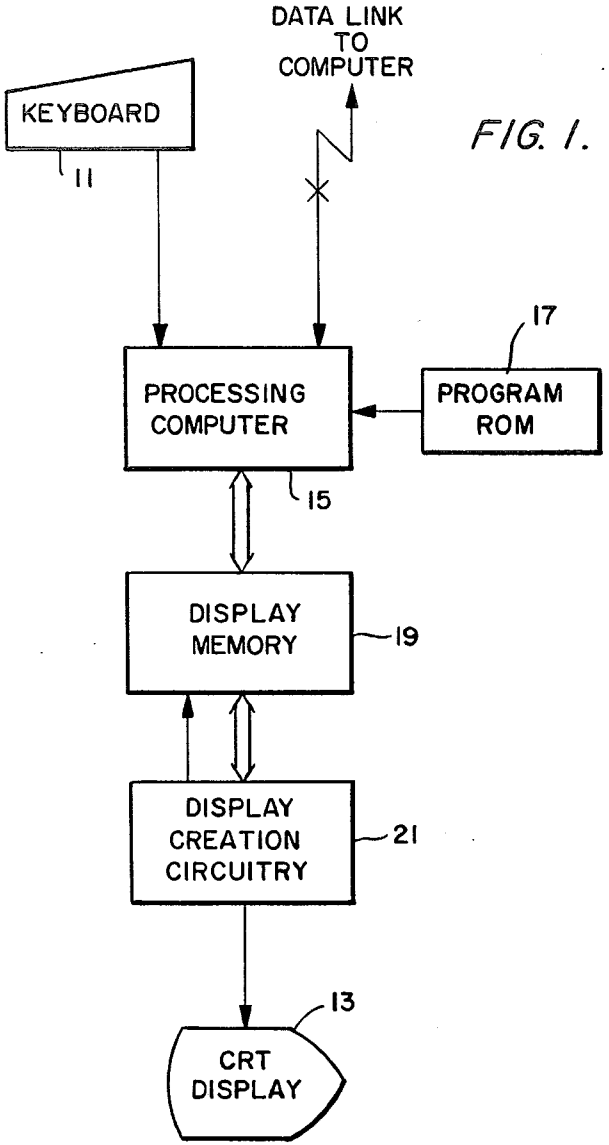
FIG. 1 is a block diagram illustrating the system of the present invention.

As shown in FIG. 1, the system of the present invention comprises a keyboard 11 for entering data representing objects to be displayed by a color cathode ray tube display 13 and representing the location of the objects on the screen of the cathode ray tube display. The information entered by the keyboard is received by a processing computer 15, which, under the control of a program stored in the program ROM 17, computes from the data entered by the keyboard series of transition specifications which are stored in a display memory 19. The cathode ray tube display 13 scans electron beams across the screen of the cathode ray tube display 13 in a conventional TV raster scan and will display images in response to applied color video signals in the manner of a conventional color TV receiver.

The display creation circuitry 21 reads out the transition specifications from the display memory 19 and converts the data from the specifications into video signals which, when applied to the CRT display device 13, cause it to display the objects described by the data entered by the keyboard 11. Similarly, the objects to be displayed may be defined and selected by computer operations or computer data via a data link. The transition specifications stored in the display memory 19 represent the objects to be displayed in terms of the location of where the raster scan lines of the CRT display 13 cross the edges of the objects to be displayed. Each time a horizontal scan line crosses the edge of an object to be displayed, there will be a transition in the video signal from the color and brightness level prior to the edge to the color and brightness after the edge. Thus, the crossings of the object's edges by the horizontal scan lines are referred to as transitions and the transition specifications stored in the display memory 19 provide all the information about each of the transitions necessary for the display creation circuitry 21 to generate the video signal which causes the CRT display device 13 to display the objects.

The transition specifications, in addition to containing information as to the location of a transition, also contain information as to the character of the transition in terms of the width of the transition and the rate of change in brightness and color across the transition. In accordance with the present invention, to reduce aliasing distortion, each transition is considered to have a width, which depends upon the angle that the object edge, which causes the transition, has with the horizontal scan line. The closer the angle between the edge and the horizontal scan line is to 90°, the smaller will be the width of the transition. The closer the edge is to parallel to the horizontal scan line, the greater will be the width of the transition. Specifically, the width of the transition is made approximately proportional to the cotangent of the angle of the horizontal scan line with the edge at the transition. Accordingly, an edge that makes an angle of 90° with the horizontal scan line is represented by a transition with a zero width so that the brightness and color of the video signal changes immediately to the final value at the transition.

For purposes of simplifying the explanation of the invention, it will be first explained in terms of a monochromatic display system wherein the objects are displayed only in different degrees of brightness. Thus, at each transition, the brightness of the video signal will be changed from the brightness level prior to the edge to the brightness after the edge. The logic of the display creation circuitry provides a horizontal resolution which is a multiple of the vertical resolution. The vertical resolution of the display depends upon the number of horizontal scan lines which is 525. The logic of the display creation circuitry 15 divides the horizontal scan lines into 4096 divisions. This provides about 3,400 divisions of the usable or visible part of a scan line. Considering the 4 to 3 ratio in the display dimensions, the horizontal resolution comes out to be about 9 times the vertical resolution. In order to provide the maximum reduction in aliasing, the width of each transition is made an approximation of the ratio of the horizontal resolution to the vertical resolution divided by the tangent of the angle that the horizontal scan line makes with the edge defining the transition. In the system of the present invention, the width of the transition, accordingly, is made equal to $8/\tan\theta$ divisions, where $\theta$ is the angle that the horizontal scan line makes with the edge defining the transition. The intensity at the transition is caused to change in steps distributed across the width of the transition so as to cause the brightness change across the width of the transition from the initial brigntness level to the final brightness level.

Figure 2:
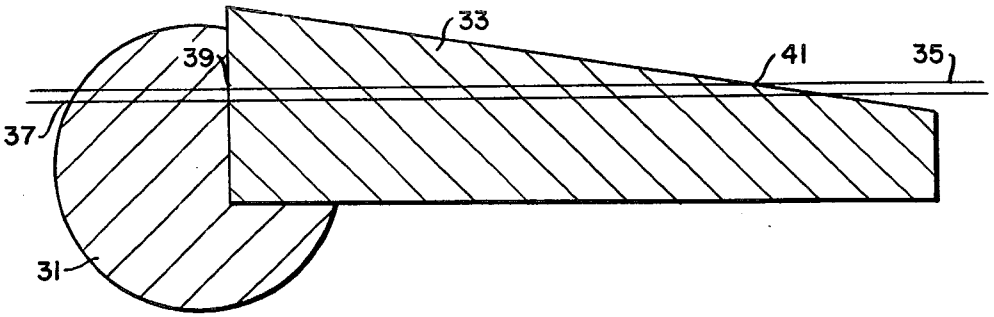
FIG. 2 illustrates an example of a display of a type which can be created, by the system of the present invention.
Figure 3:
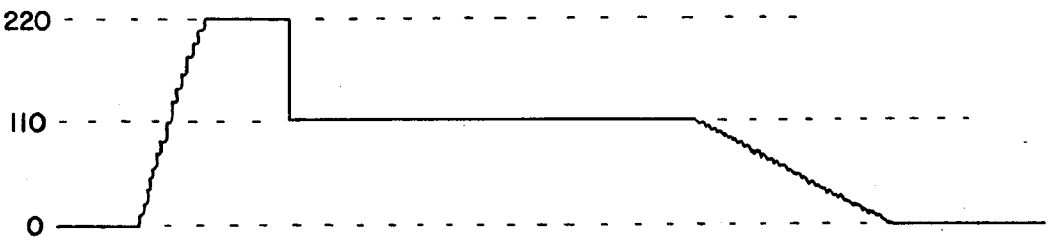
FIG. 3 is an example of a video intensity signal as a function of time for one horizontal scan line to generate the display shown in FIG. 2.

An example of how the system of the invention operates for one color or for a monochromatic system to control the width of the transition and the change in intensity across the transition is illustrated in FIGS. 2 and 3. FIG. 2 illustrates objects to be displayed comprising a disc 31 and a trapezoid 33 partially covering the disc 31. In the monochromatic example of the explantion, the background intensity surrounding the objects 31 and 33 is zero, the circle has an intensity of 220, and the trapezoid 33 has an intensity of 110. (The intensity units correspond to the smallest increment by which the video intensity can be changed by the system logic.) The horizontal scan line 35 thus undergoes a transition from zero intensity to 220 at the point 37, where the scan line 35 crosses into the disc 31, a transition from 220 to 110 at the point 39 where the scan line crosses into the trapezoid 33, and a transition from 110 to zero at the point 41 where the scan line crosses out of the trapezoid 33. The angle that the disc edge makes with the scan line 35 at point 37 is 26° so $8/\tan 26° = 16$. Accordingly, the width of the transition at the point 37 is 16 units of the 3400 divisions of the visible horizontal scan line. Accordingly it is desired to step the video intensity from zero to 220 in 16 divisions of the horizontal scan line as the cathode ray tube beam sweeps past the position of the point 37. The display creation circuitry 21 thus will produce a video signal to increase the intensity from 0 to 220 in 16 steps. Since 220 divided by 16 is 13.75, the step size for each horizontal division is selected accordingly. The display creation circuitry 21 causes the intensity to increase in steps of 13 or 14 units for each horizontal division as the electron beam moves across the disc edge at the point. The step size will vary between 13 and 14 so that the average intensity step is about 13.75. After 15 steps, the intensity will have been increased to 206. In order to ensure an accurate final intensity, at the final or 16th step of the transition, the intensity is increased to the final intensity of 220.

At the point 39 on the edge of the trapezoid 33, the intensity changes from 220 to 110. The angle $\theta$ that the edge makes with the horizontal scan line is 90° at point 39 so the transition width is zero. Accordingly, the intensity is changed at the point 39 in one step from 220 to 110. At the point 41 on the edge of the trapezoid, the intensity undergoes a change from 110 to zero. The angle $\theta$ at the point 41 is 2.5 degrees and 8/tan 2.5°=183. Since 110 divided by 183 is 0.601, less than one, the intensity is stepped either one unit or not at all for each horizontal division so the average increase in intensity per horizontal division is made to equal about 0.601. The resulting video intensity waveform as a function of time that would be produced by the example of FIG. 2 is shown in FIG. 3.

In addition to determining the transition width and step size, the starting position of the transition must be determined so as to center the transition on the edge point that it represents. In the examples shown in FIG. 3, the horizontal position of the point 37 is on the 100th horizontal scan line division. Since one-half of the transition width is 8, the starting position for the transition is selected to be 100−8=92. The point 39 is at horizontal division 170, so at the 170th horizontal division, the intensity is changed in one step from 220 to 110. The horizontal position of the point 41 is 490. One-half of the transition width is 91 so the starting position for the transition at point 41 is 490−91=399.

The above description has been explained in terms of a monochromatic display. To provide a full color display, it will be understood that each of the three color video signals controlling the red, blue and green intensities will be controlled independently as described above in the monochromatic example.

As indicated above, data is entered by the keyboard 11 or from computer operations to represent the object to be displayed. If the object to be displayed is a polygon, then the data entered by the keyboard would specify (1) that the displayed object is a polygon, and (2) the positions of the vertices of the polygon. If the object to be displayed is a circular disc, then the data entered would specify the position of the center of the disc and the radius of the disc. A straight line would be specified by its end points and its width. In addition to the above information, the entered data would specify the color brightness and depth level of the object to be displayed. Each object will be at one of eight depth levels to determine which objects will be in front of and obscure which of the objects. From the entered data, the computer 15 computes the transition specifications and stores the transition specifications in the memory 19. Each transition specification will contain the following information: (1) a number identifying the object, the edge of which is represented by the transition; (2) whether the transition is a leading edge or a trailing edge, a leading edge being a point where the horizontal scan line crosses into the object and a trailing edge being where the horizontal scan line crossses out of the object; (3) a number identifying the horizontal scan line on which the transition occurs; (4) a number identifying the horizontal position of the start of the transition in horizontal scan line divisions (this starting position must be computed from the actual horizontal position of the edge point causing the transition minus half the width of the transition); (5) the address of then next transition specification to be encountered in the raster scan (this address is referred to as a linking address and the list of linking addresses is referred to as a linked list); (6) the step count which is equal to the width of the transition in horizontal scan line divisions; and (7) a number identifying the depth level of the object causing the transition. In addition, for each color red, green and blue, the following information is stored: (1) the final intensity to which the color is to be changed at the transition; and (2) the transition intensity step size, which is the average amount that the intensity is changed per horizontal division.

The linking addresses stored in the transition specifications are used to control the sequence in which the transitions represented by the transition specifications are read out of the display memory 19 and cause transitions to be generated by the display creation circuitry 21. In accordance with the present invention, the objects displayed may be made to blink on and off. To provide this feature, each transition specification contains one linking address to designate the location in the display memory of the next transition specification in the raster scan sequence with blinking objects on and another linking address to designate the next transaction specification in the raster scan sequence with blinking objects off.

Since the objects may be positioned in front of one another, the edges of some of the objects to be displayed may be hidden or invisible. Transition specifications for the hidden edges are retained in the display memory. However, the display creation circuitry is not concerned with these invisible edges and the linking addresses controlling the sequence in which the transitions are generate disregard these hidden edges. Nevertheless, each transition specification, in addition to the linking addresses which control the sequence of transition generation, also contain additional linking addresses pointing to the next transition in the display, whether hidden or not, thus forming another linked list. To distinguish the former linked list of addresses, which represent the chain of only displayed transitions, from the latter linked list of addresses, which represent all the object edge transitions in the display whether hidden or visible, the former linked list shall be referred to as the display linked list and the addresses thereof referred to as the display linking addresses. The latter linked list shall be referred to as the universal linked list and the addresses thereof referred to as the universal linking addresses. In addition, each object is considered to have a depth in the display to determine whether or not the object is in front or behind another object and, thus, determine whether a given transition specification represents a visible or invisible edge. For this purpose, when each object is entered into the system by the keyboard or by computer operations, it is assigned 1 of 8 possible depths and this depth information is indicated in each transition specification representing an edge point on the object. This depth information is not employed by the display creation circuitry, but it is used by the computer to determine where in the sequence of displayed transitions, as determined by the display linking addresses, each transition specification is to go.

Figure 4:
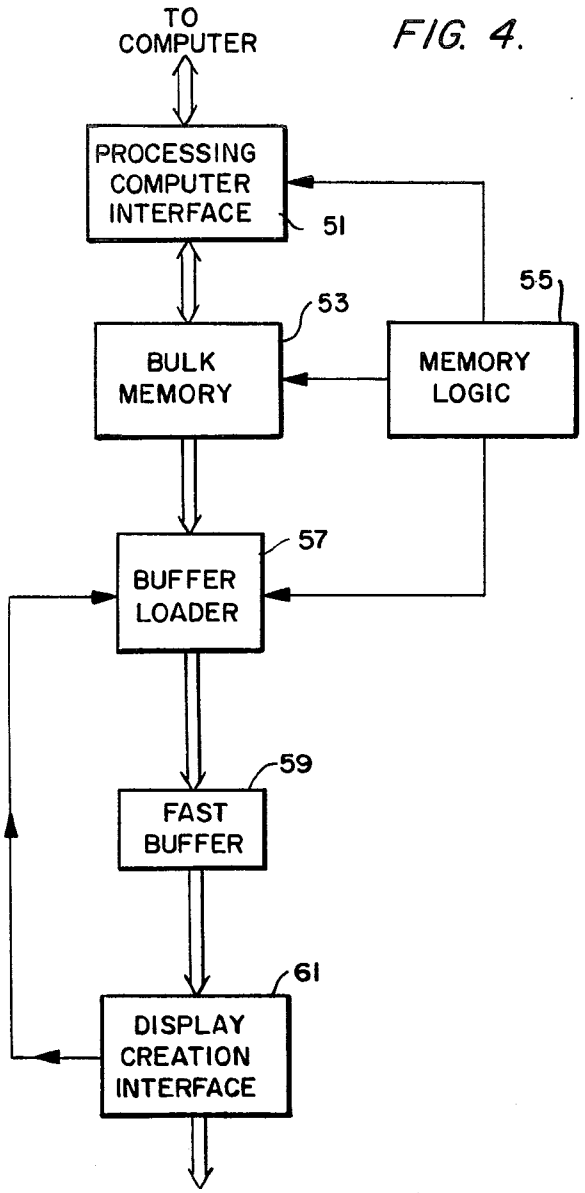
FIG. 4 is a block diagram showing in more detail the display memory which is shown as a block in FIG. 1.

In the display memory, as shown in FIG. 4, the transition specifications are stored in the bulk memory 53 by the computer 15 via interface circuitry 51 as they are computed by the computer 15. Each time the computer 15 stores a new transition specification in the bulk memory, it finds the transition specification immediately preceeding that currently being stored in the raster scan sequence and changes the universal linking addresses of the preceeding transition specification to indicate the location in which the new transition specification is being stored. In addition, if the new transition specification represents a displayed transition, the computer finds the immediately preceeding transition specification representing a displayed transition and changes the display linking address of that preceeding transition specification to indicate the location in which the new transition specification is being stored. This operation is carried out for display linked lists for blinking objects on and for blinking objects off. The universal linking addresses in the new transition specification are set to point to the next transition specification representing an edge in the raster scan sequence whether visible or not and the display linking addresses of the new transition specification are set to a point to the next transition specification representing a visible object edge in the display. In this manner, each new transition specification is inserted in the universal chain or sequence of all object edge transitions and each transition specification representing a displayed transition is stored in the chain or sequence of all displayed transitions.

A buffer loader 57 operates to read the transition specifications representing displayed transitions out of the bulk memory 53 in the order that they occur in the raster scan and stores the transition specifications in the fast buffer 59. To accomplish this sequencing, the buffer loader stores the two display linking addresses read out from the previous transition specification and then uses one of these addresses to locate the next transition specification to be read out. As explained above, one of the display linking addresses is for blinking objects on and one is for blinking objects off. The display linking addresses are alternately selected in successive time intervals to provide the desired blinking.

A blinking object may obscure an edge, a surface, or a line which is not visible when the blinking object is on, but which is visible when the blinking object is off. This feature results from the fact that each set of display linking addresses, one for blinking objects on and one for blinking objects off, links a set of transition specifications representing an entire displayed scene and the displayed scene for blinking objects on may cover up edges, lines or surfaces which appear in the displayed scene for blinking objects off.

A dummy transition specification is permanently stored in the bulk memory 53 and it is considered to represent a displayed transition occurring on line 525 at position 4095 at "background" color. This dummy transition specification will contain a display linking address pointing to the location of a transition specification representing the first displayed transition to occur in the raster scan and the display linking addresses of the transition specification representing the last real displayed transition in the raster scan will point to the location of the dummy transition specification. To get into the display linking address sequence, the buffer loader 57 on being powered up reads out the dummy transition specification. The display linking addresses of the dummy transition specification will then select the transition specification of the first displayed transition in the raster scan to be the next transition specification read out by the buffer loader and the readout then proceeds in the proper sequence as controlled by the display linking addresses.

If desired, multiple scenes may be stored in the memory with each scene represented by an entire set of transition specifications. A given scene may be selected to be displayed by causing the linking address in the dummy transition specification to point to the first transition specification of the selected scene.

Memory logic 55 functions to prevent contention between storage of transition specifications by the computer 15 via the interface circuitry 51 and the read out of transition specifications by the buffer loader 57. The bulk memory in the specific embodiment is a dynamic memory and the logic 55 also serves to periodically refresh the information in the bulk memory 53 to prevent loss of information. The transition specifications stored in the fast buffer 59 are read out by the interface 61 for the display creation circuitry 61 in the same sequence that the transition specifications are stored in the fast buffer 59. The fast buffer 59, thus, in effect, is a first-in first-out memory. The reason for having the fast buffer 59 is that the bulk memory 53 must be a large memory and, as a result, has a relatively slow access time, for example, 300 nanoseconds. The transitions that occur on a horizontal scan line, on the other hand, may occur at time intervals which are closer together than 300 nanoseconds. The fast buffer, by using a static random access memory, has a 30 nanosecond access time and the transition specifications stored in the fast buffer 59 can be read out at the same rate that the transitions occur in real time on the horizontal scan line. As each transition specification is read out from the fast buffer 59, the display creation circuitry interface 61 will apply to the display creation circuitry binary signals representing the scan line number and the horizontal position of the transition starting position. In addition, the interface 61 will apply sets of signals representing the step count, the step size, and the final intensity for each of the three colors red, green and blue.

Figure 5:
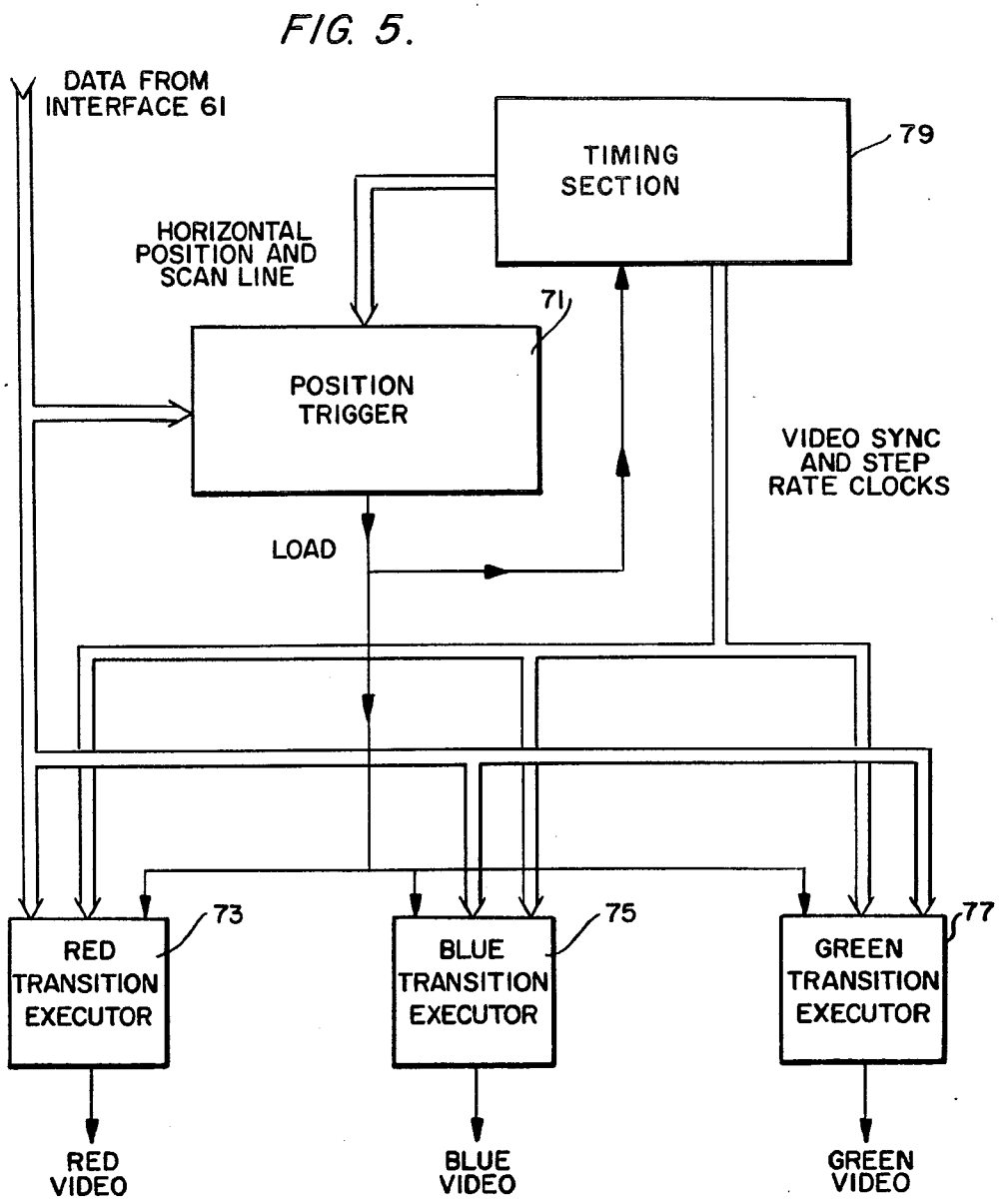
FIG. 5 is a block diagram illustrating in more detail the display creation circuit which is shown as a block in FIG. 1.

As shown in FIG. 5, the signals representing the horizontal scan line number and the horizontal position of the transition starting position are applied to the position trigger 71 from the interface 61. The signals representing the step size and the final intensity for each of the colors and the step count are applied to the red transition executor 73, blue transition executor 75 and green transition executor 77, respectively, by the interface 61. A timing section 79 keeps track of the current position of the electron beam in the raster scan and sends signals representing the scan line and horizontal position of the electron beam to the position trigger 71. When the scan line and horizontal position of the electron beam equal the scan line number and horizontal position number applied to the position trigger 71 by the interface 61, the position trigger 71 will generate a load pulse applied to the red, blue and green transition executors 73, 75 and 77. The load pulse applied to the transition executors causes the step count to be loaded into a counter in each executor as will be explained below with reference to FIG. 6.

Figure 6:
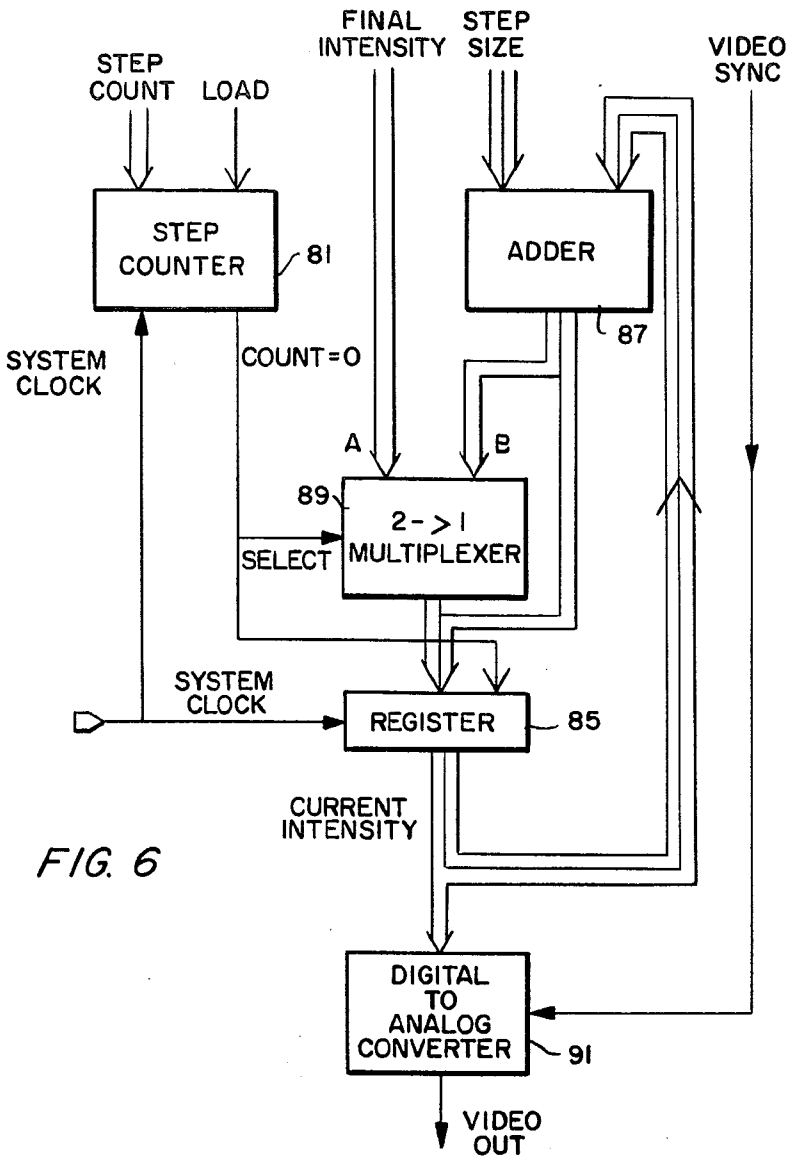
FIG. 6 is a block diagram illustrating in more detail one of the transition executors shown as blocks in FIG. 5.

FIG. 6 shows one of the three transition executors 73, 75 and 77, the circuitry for each transition executor being identical. As shown in FIG. 6, signals representing the step count are applied by the interface 61 to a step counter 81 where the step count is stored in response to the load pulse. Signals representing the step size, in 16 binary bits, are applied to a 16 bit adder 87. Signals representing the eight most significant bits in the adder are applied to 8 bit multiplexer 89, which also receives signals representing the final intensity from the interface 61. The output of the multiplexer 89 is applied to eight most significant bits of a 16 bit register 85. The eight least significant bits of the adder are applied to the eight least significant bits of the register 85. Signals representing the 16 bit value in the register 85 are applied to the adder 87 where the value is added to the value of the step size applied to the adder from the interface 61. The signals in the register 85 represent a video intensity and the value represented by the 8 most significant bits thereof is converted by a digital-to-analog converter 91 to an analog signal to control the video intensity.

Before a load pulse is received, the value stored in the register 85 will normally be the final intensity from the previous transition specification last read out from the display memory and accordingly, the digital-to-analog converter 91 will be producing an analog signal to produce a video intensity corresponding to this previous final intensity. Signals representing this final intensity will also be applied to the adder 87. When the next transition specification is read out from the fast buffer 59, signals representing the step size in this next transition specification are applied to the adder 87 by the interface 61 and are added to the previous final intensity. The sum of the two applied values are applied to the multiplexer 89 by the adder 87. The multiplexer 89 applies either the applied signals from the adder 87 or the signals representing the final intensity to the register 85 depending upon whether the count in the counter 81 is zero. If the count is zero, the multiplexer applies the signals representing the final intensity and, at the same time, sets the eight least signficant bits in the register 85 to zero. If the count is not zero, the multiplexer 89 applies the signals from the adder 87. As indicated above, as soon as the load pulse is applied to the step counter 81, the step count is loaded into the counter 81 and, accordingly, at this time, the count would usually not be zero. Accordingly, the multiplexer 89 will begin applying the output of the adder 87 to the register 85. Then, when the next clock pulse is received by the register 85, it will cause the output of the adder 87 to be stored in the register 85 and, at the same time, the counter 81 will count this clock pulse to begin counting down toward zero. As a result, the value stored in the register 85 will become the previous final intensity plus the added step size. Then, with each additional clock pulse, the value in the register 85 will be changed by the step size, until the count in the counter 81 reduces to zero, whereupon the counter 81 will cease counting and will apply a signal to the multiplexer 89 and cause it to select the applied final intensity signals and store this value in the register 85. Thus, the value in the register 85 is changed in steps from the final intensity of the previous transition to the new final intensity of the current transition. The digital-to-analog converter controls the video intensity signal in steps corresponding to the changes in the value stored in the register 85.

It will be noted that while the step size is represented by 16 binary bit values and the current video intensity is computed to 16 binary bits by the adder 87 and stored in the register 85, only the 8 most significant bits are applied to the digital-to-analog converter and converted into an analog video intensity signal. By using only the 8 most significant bits in the computed intensity, only an 8 bit digital-to-analog converter is required. Changes in intensity represented with higher precision would not be noticeable. With the units of intensity being defined as the smallest increment by which the intensity can be changed, the 8 most significant bits in the register 85 represent values of one and greater and the 8 least significant bits represent values of less than one. By representing the step size with a precision of 16 binary bits and computing the intensity with this precision in the register 85, the step increase per horizontal division of a scan line can be made to have an average value closely approximating the value of the step size as precisely represented by the 16 binary bits. This is significant when the transition is a wide, gradual transition and the average step size is less than one. By calculating and controlling the intensity as described above, the system will cause the intensity to increase in integral increments distributed across the width of the transition. For example, if the step size is 0.5, then the intensity will be increased by one on every other horizontal division of the scan line. Note that since each of the three colors typically have different step sizes, their lack of synchronization enhance the illusion of a smooth, continuous transition.

When the transition has no width, the step count loaded into the counter 81 is zero and, accordingly, the first clock pulse will cause the new final intensity to be loaded in the register 85. In this manner, in the instance of zero transition width, the intensity value is changed immediately to its new value at the horizontal position of the transition.

Figure 7:
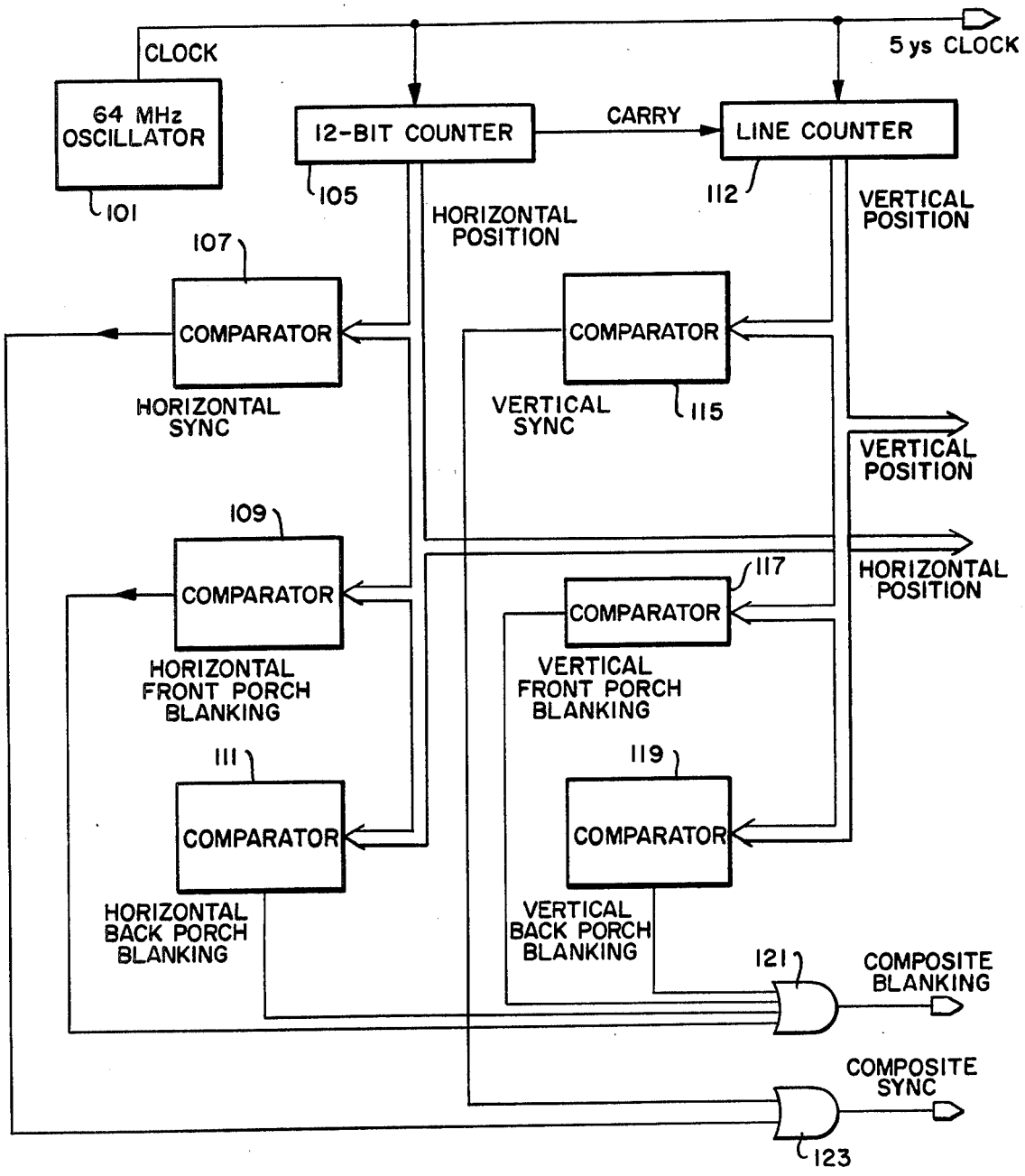
FIG. 7 is a block diagram illustrating in more detail the timing section shown as a block in the diagram of FIG. 5.

The timing section 79, as shown in more detail in FIG. 7, comprises a 64 megahertz oscillator 101, the output of which is applied to a 12-bit counter 105. The counter 105 provides a multi-bit binary signal representing the horizontal position of the electron beam sweep in the cathode ray tube raster scan. In addition, the output of the counter 105 is applied to comparators 107, 109 and 111 which generate the horizontal sync pulses, the horizontal front porch blanking and the horizontal back porch blanking, respectively, for the raster scan. The 12-bit counter 105 also generates a carry pulse at the end of each sweep of each horizontal line, which carry pulse is applied to and counted by a line counter 112. The count in the line counter 112 continuously represents the line currently being scanned in the raster scan and the line counter 112 produces binary signals representing this value. The output signals from the line counter are applied to comparators 115, 117, and 119 which generate the vertical sync pulse, the vertical front porch blanking and the vertical back porch blanking, respectively, for the raster scan. The sync pulses produced by the comparators 107 and 115 are combined into a composite sync signal by an OR gate 123. The outputs of the comparators 109, 111, 117 and 119 are combined in an OR gate 121 to provide a composite blanking signal. The composite blanking signal and composite sync are applied to the cathode ray tube display device 13 to provide synchronization and appropriate blanking of the raster scan generated by the display device 13.

Figure 8:
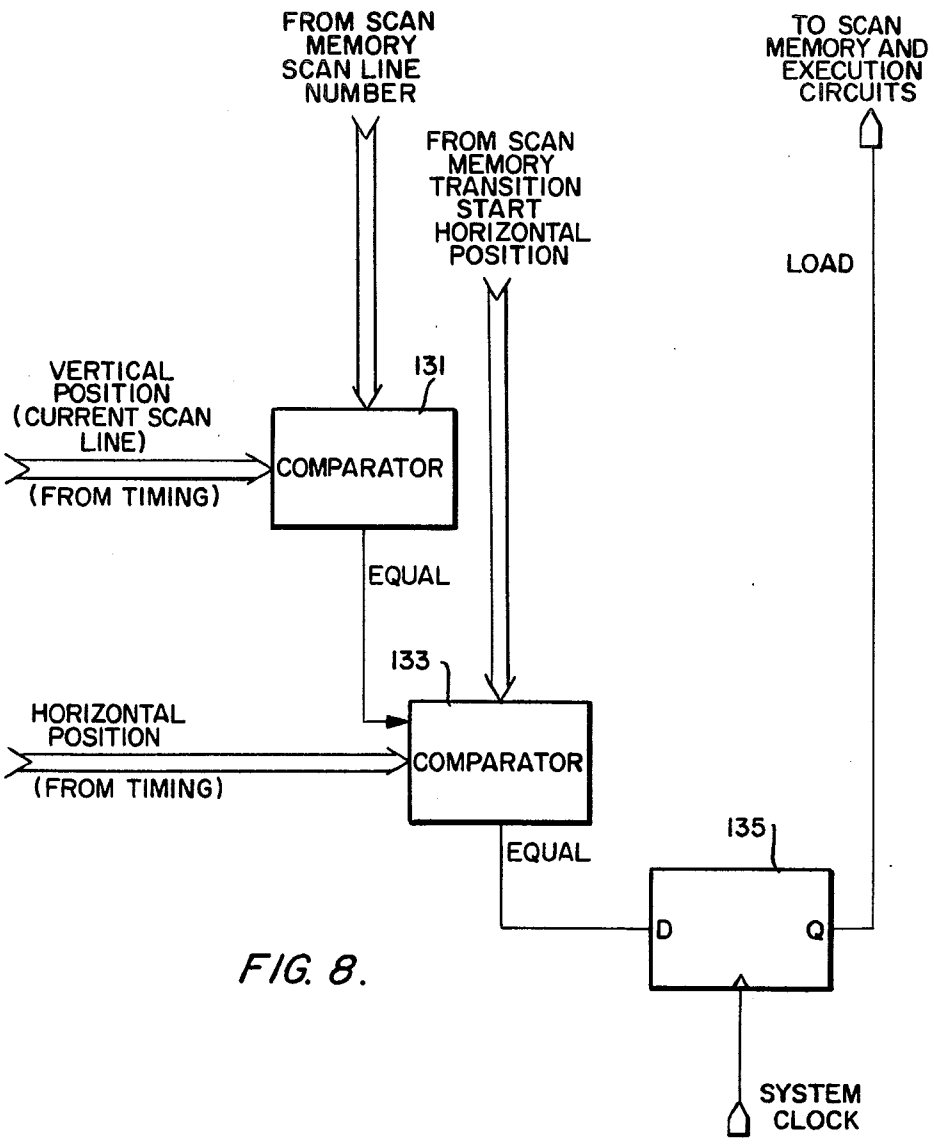
FIG. 8 is a block diagram illustrating in more detail the position trigger shown as a single block in the diagram of FIG. 5.

The position trigger 71 as shown in FIG. 8 comprises a comparator 131 and a comparator 133. The comparator 131 receives the scan line number applied thereto by the interface 61 in the latest transition specification read out from the fast buffer 59 and also receives signals representing the current vertical position of the electron beam in the raster scan represented by the output signals of the line counter 112 in the timing section. When the current vertical position of the electron beam in the raster scan equals the scan line number applied by the interface 61, the comparator 131 will provide an enabling signal to the comparator 133. The comparator 133 receives signals applied thereto by the interface 61 representing the horizontal position in the latest transition specification read out from the fast buffer 59 and it also receives signals representing the current horizontal position of the electron beam in the raster scan represented by the output signals of the counter 105. When the current horizontal position of the electron beam in the raster scan equals the horizontal position applied by the interface 61 and the comparator 133 is also receiving an enabling signal from the comparator 131, this will mean that the electron beam position in the cathode ray tube display device is at the position specified in the latest read out transition specification and the comparator 133 will generate a signal to enable a flip-flop 135. On the next system clock signal generated by the oscillator 101, the flip-flop 135 will be switched to generate the load pulse which, as explained above, is applied to the step counter 81 to load the step count from the transition specification currently being read out of the fast buffer 59.

Because in accordance with the present invention, the transitions have widths, it is possible for transitions adjacent to one another to overlap; that is, the next transition may start before the preceeding transition is completed. There are 11 different situations of overlapping edges, which are taken into account by the system of the invention by means of a composite transition consisting of a plurality of contiguous transitions usually including extra transitions specially computed for the overlapping situations. The specially computed transitions are called orphan transitions. Orphan transition specifications are generated for the orphan transitions, which are inserted in the chain of displayed transitions by appropriate display linking addresses in the orphan transition specifications and in the specifications of transitions immediately preceeding the orphan transitions in the displayed chain of transitions. The orphan transitions are not included in the universal chain of transitions corresponding to object edges as they occur in the raster scan whether displayed or not. The orphan transition specifications contain only the starting position of the transition, the width of the transition, the step size for each color, the final brightness for each color, and the necessary display linking addresses.

The 11 different overlapping situations are schematically represented in FIGS. 9A–9K. In each of these overlapping situations, the overlapping transitions are designated $T_1$ and $T_2$ with $T_1$ designating the deep transitions and $T_2$ indicating the shallow transitions in the display. To simplify the explanation, the different overlapping situations will be explained for a monochromatic example with the understanding that the computation for each overlapping situation is carried out in an analogous manner for each of the three video colors. In each of the 11 situations, the object brightness to which the transition $T_1$ is changing in the case of a leading edge or from which the transition is changing in the case of a trailing edge is $B_1$. The object brightness to or from which the transition $T_2$ is changing is $B_2$. The background brightness is $B_3$.

Figure 9A:
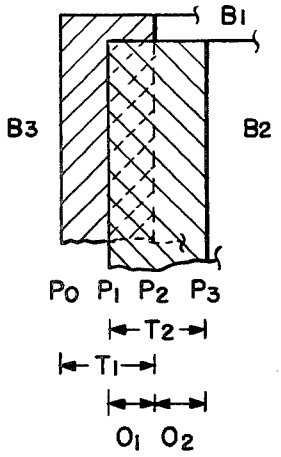
FIGS. 9A–9K illustrate 11 different situations of overlapping displayed object edges, which situations are taken into account by the system of the present invention.

FIG. 9A represents the overlapping situation in which $T_1$ and $T_2$ are both leading edges with the deep transition $T_1$ starting first at position $P_0$ and ending in the middle of transition $T_2$ at position $P_2$ and transition $T_2$ starting at position $P_1$ and ending at $P_3$. Accordingly, over both transitions $T_1$ and $T_2$, the brightness must be changed from $B_3$ to $B_2$. Transition $T_1$ is computed in a normal manner from brightness $B_3$ to $B_1$ over the width from position $P_0$ to $P_2$ and is inserted in the chain of displayed transitions. However, instead of using transition $T_2$, two orphan transitions $O_1$ and $O_2$ are computed and inserted in the displayed chain following transition $T_1$, the orphan transition $O_1$ extending from position $P_2$ to $P_3$ and the orphan transitions $O_2$ extending from the position $P_2$ to $P_3$. To compute the orphan transitions $O_1$ and $O_2$, the brightness at the positions $P_1$ and $P_2$ must be computed. The brightness at $P_1$ is computed simply by determining the brightness of the transition $T_1$ at the position $P_1$. The brightness at the position $P_2$ is computed by mixing the brightness $B_1$ with the brightness $B_2$ in proportion to the amount of the transition $T_2$ that is traversed at point $P_2$. In other words, the brightness at point $P_2$ is computed by assuming that the transition $T_2$ is changing from brightness $B_1$ to brightness $B_2$ and determining what its brightness would be at position $P_2$. After the brightness at positions $P_1$ and $P_2$ are computed, the step size for the orphan transitions can be computed. The orphan transition $O_1$ is computed by taking the brightness at position $P_2$ as the final brightness and determining the step size from the width of the orphan transition from $P_1$ to $P_2$ and the change from the computed brightness at position $P_1$ to the final brightness computed for position $P_2$. Orphan transition $O_2$ is computed setting $B_2$ as the final brightness and determining the step size from the width of the transition and the change in brightness from the computed brightness at $P_2$ to $B_2$.

The orphan transitions $O_1$ and $O_2$ are inserted in the chain of displayed transitions with $O_1$ coming after the transition $T_1$ and $O_2$ coming after the transition $O_1$. The display creation circuitry will display the overlapping transitions by starting transition $T_1$ in a normal manner. Then, when it gets to position $P_1$, it will leave the transition $T_1$ uncompleted and will immediately begin transition $O_1$ and carry out the display of transition $O_1$ from positions $P_1$ to $P_2$. In other words, the transition $T_1$ is superceded by the transition $O_1$. Then, after the display of transition $O_2$, the display of transition $O_2$ will be carried out from position $P_2$ to position $P_3$. Thus, the overlapping transitions are represented by a composite transition comprising part of $T_1$ superceded by $O_1$ followed by $O_2$.

Figure 9B:
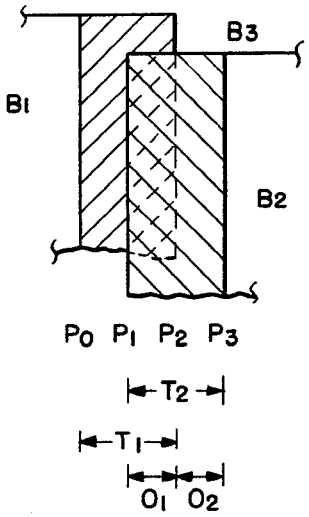

In the situation of FIG. 9B, the deep transition $T_1$ is a trailing edge transition from position $P_0$ to $P_2$ and the shallow transition $T_2$ is a leading edge transition which starts at $P_1$ in the middle of the transition $T_1$ and ends at $P_3$ after the end of the transition $T_1$. For this situation, orphan transitions $O_1$ and $O_2$ are used in place of the transition $T_2$. The transition $T_1$ is computed in the normal manner from brightness $B_1$ to $B_3$ and the orphan transitions $O_1$ and $O_2$ are computed in a similar manner as in the situation of FIG. 9A. The starting brightness for the orphan $O_1$ is the brightness of the transition $T_1$ at the position $P_1$. The brightness at the position $P_2$, which becomes the final brightness for the orphan $O_1$ and the starting brightness for the orphan $O_2$ is determined by mixing the brightness $B_3$ with the brightness $B_2$ in proportion to the amount of the transition $T_2$ that is traversed at the point $P_2$. The final brightness for the orphan $O_2$ is the brightness $B_2$. Once these brightness levels have been determined, the step sizes for the orphans can be computed as described above.

Figure 9C:
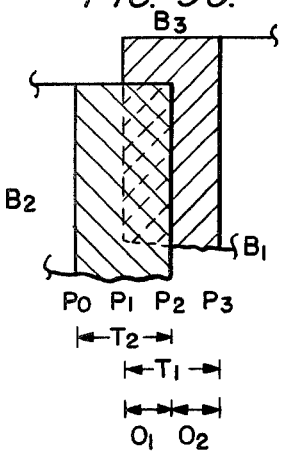

In the situation of FIG. 9C, the shallow transition $T_2$ is a trailing edge transition and begins before the start of the deep leading edge transition $T_1$ at position $P_0$ and ends in the middle of the transition $T_1$ at position $P_2$. The transition $T_2$ starts at position $P_1$ and ends at position $P_3$. In this situation, the transition $T_2$ is computed selecting the brightness $B_3$ as the final brightness and $T_2$ is inserted in the chain of displayed transitions. An orphan transition $O_1$ is computed for the traverse from $P_1$ to $P_2$ and an orphan transition $O_2$ is computed for the traverse from $P_2$ to $P_3$. These orphan transitions are also inserted in the chain of displayed transitions. To compute the orphan transitions $O_1$ and $O_2$, the brightnesses at the points $P_1$ and $P_2$ have to be determined. The brightness at position $P_1$ is determined by computing the brightness of the transition $T_2$ at the position $P_1$. The brightness at the position $P_2$ is computed by mixing brightness $B_3$ with brightness $B_1$ in proportion to the amount of transition $T_1$ that is traversed at position $P_2$. As in the case of the situation of FIG. 9A, the brightness at position $P_2$ becomes the final brightness for the orphan transition $O_1$. The final brightness for the orphan transition $O_2$ is $B_1$. Once the brightness values at $P_1$, $P_2$ and $P_3$ have been determined, the step size is determined as described above.

Figure 9D:
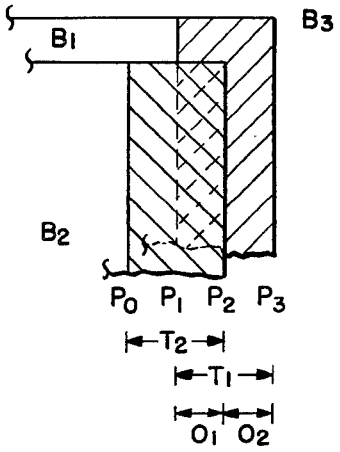

In the situation of FIG. 9D, both transitions are trailing transitions with the shallow transition $T_2$ starting from position $P_0$ before the deep transition $T_1$ and ending in the middle of the transition $T_1$ at position $P_2$ and the deep transition starting from position $P_1$ and going to position $P_3$. In this situation, the transition $T_2$ is computed considering the brightness $B_1$ to be the final brightness at position $P_2$ and $T_1$ is inserted in the chain of displayed transitions. An orphan transition $O_1$ is computed for the traverse from $P_1$ to $P_2$ and an orphan transition is computed for the traverse from $P_2$ to $P_3$. The brightness at the position $P_1$ is computed by determining the brightness of the transition $T_2$ at the position $P_1$ and the brightness at the position $P_2$ is determined by mixing the brightness $B_1$ with $B_3$ in proportion to the amount of transition $T_1$ traversed at position $P_2$. The orphan transitions are then computed and inserted in the chain of displayed transitions in the same manner as described above.

Figure 9E:
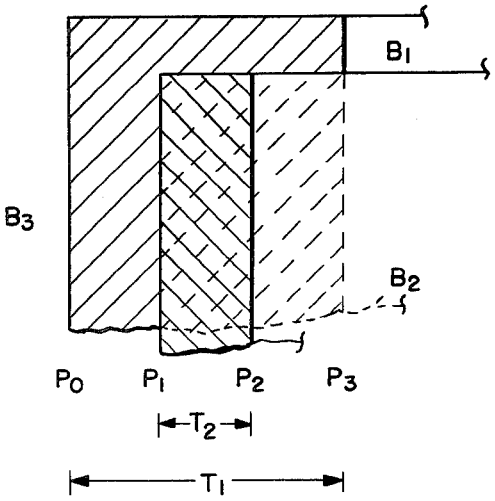

In the situation of FIG. 9E, both transitions $T_1$ and $T_2$ are leading transitions with the shallow transition starting at point $P_1$ in transition $T_1$ and ending at position $P_2$ in transition $T_1$. The transition $T_1$ goes from position $P_0$ to $P_3$. No orphan transitions are needed for the situation of FIG. 9E. The transition $T_1$ is computed in the normal manner from brightness $B_3$ and $B_1$ and inserted in the displayed chain. However, in order to determine the step size for the transition $T_2$, the starting brightness for this transition must be computed by determining the brightness in the transition $T_1$ at the position $P_1$. The transition $T_2$ is then computed using the brightness $B_2$ a the final brightness. When the transitions are displayed, transition $T_2$ will supercede the transition $T_1$ at the position $P_1$.

Figure 9F:
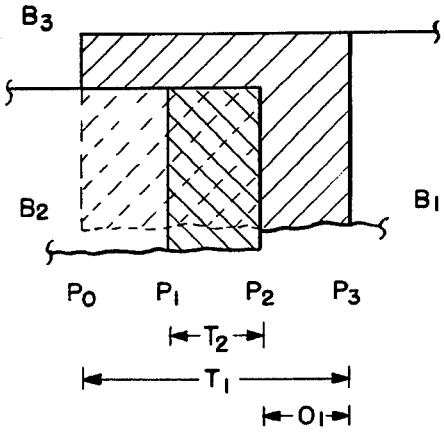

FIG. 9F represents a situation in which the deep transition $T_1$ is a leading transition from position $P_0$ to $P_3$ and transition $T_2$ is a trailing transition from $P_1$ to $P_2$ wholly within transition $T_1$. For this situation, an orphan transition must be computed for the traverse between $P_2$ and $P_3$ and the brightness for the position $P_2$ must be computed by mixing the brightness $B_3$ with brightness $B_1$ in proportion to the amount of the transition $T_1$ traversed at position $P_2$. The transition $T_2$ is computed from position $P_1$ to $P_2$ with the knowledge that $B_2$ is the starting brightness and using the brightness computed for the position $P_2$ as the final brightness and the transition $T_2$ is inserted in the displayed chain. The orphan transition is computed using the brightness $B_1$ as the final brightness with the knowledge that the computed brightness at position $P_2$ is the starting brightness.

Figure 9G:
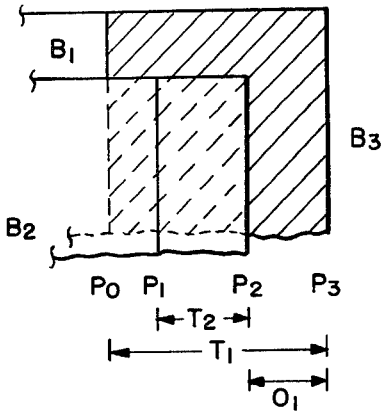

In the situation represented by FIG. 9G, both transitions are trailing edge transitions with the deep transition $T_1$ going from position $P_0$ to position $P_3$ and the transition $T_2$ starting at position $P_1$ within the transition $T_1$ and ending at position $P_2$ within the transition $T_1$. This overlapping situation is represented by the composite of the transition $T_2$ from position $P_1$ to $P_2$ and an orphan transition from $P_2$ to $P_3$. The brightness at the position $P_2$ is computed by mixing the brightness $B_1$ with the brightness $B_3$ in proportion to the amount of transition $T_1$ traversed at position $P_2$. The transition $T_2$ is computed with the knowledge that the brightness $B_2$ is the starting brightness at position $P_1$ and using the computed brightness at position $P_2$ as the final brightness and the transition $T_2$ is inserted in the displayed chain of transitions. The orphan transition $O_1$ is computed in the same manner as described above using the brightness at position $P_2$ as the starting brightness and the brightness $B_3$ as the final brightness and this orphan transition is inserted in the displayed chain immediately after the transition $T_2$.

Figure 9H:
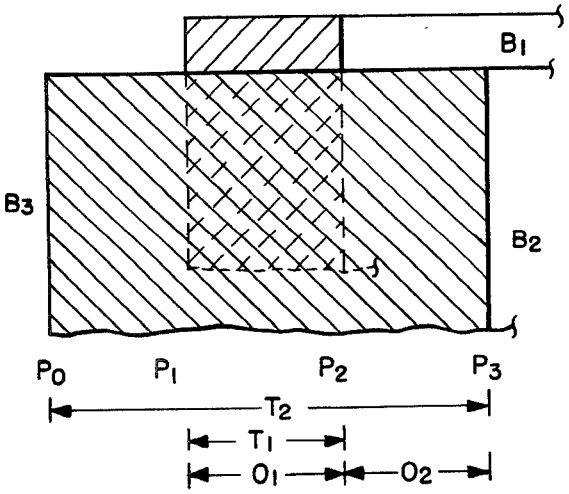

In the situation of FIG. 9H, the transitions $T_1$ and $T_2$ are both leading edge transitions with the deep transition $T_1$ beginning and ending within the shallow transition $T_2$. The transition $T_2$ goes from position $P_0$ to $P_3$ and the transition $T_2$ goes from position $P_1$ to $P_2$. For this situation, the transition $T_2$ is computed in a normal manner for position $P_0$ to $P_3$ with brightness changing from $B_3$ to $B_2$ and orphan transitions $O_1$ and $O_2$ are computed from position $P_1$ to $P_2$ and from position $P_2$ to $P_3$. The brightness at position $P_1$ is computed by determining the brightness of the transition $T_2$ at this position. The brightness at position $P_2$ is computed by mixing the brightness $B_1$ with the brightness $B_2$ in proportion to the amount of the transition $T_2$ traversed at position $P_2$. The orphan transitions $O_1$ and $O_2$ are then computed in the same manner as described above from the beginning and ending brightness levels and the composite transition is provided by inserting the transition $T_2$ and the orphan transitions $O_1$ and $O_2$ in the displayed chain of transitions.

Figure 9I:
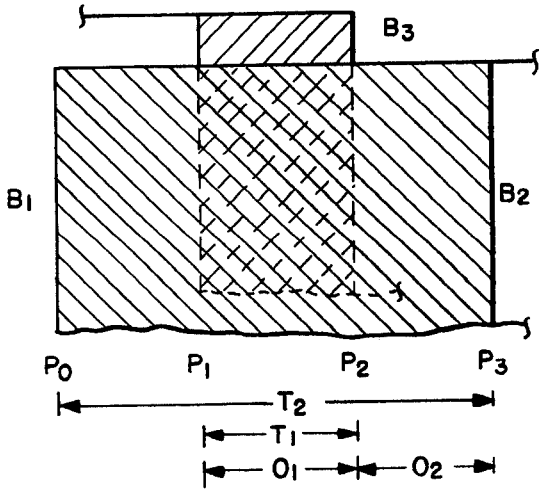

In the overlapping situation of FIG. 9I, the shallow transition $T_2$ is a leading transition and the deep transition $T_1$ is a trailing transition which begins and ends in the middle of transition $T_2$. Transition $T_2$ goes from position $P_0$ to $P_3$ and the transition $T_1$ goes from position $P_1$ to $P_2$. This overlapping situation is represented in the displayed chain by the transition $T_2$ computed in the normal manner from brightness $B_1$ to $B_2$, an orphan transition $O_1$ from position $P_1$ to $P_2$ and orphan transition $O_2$ from position $P_2$ to $P_3$. The brightness at the position $P_1$ is determined by the brightness of the transition $T_2$ at the position $P_1$. The brightness at position $P_2$ is computed by mixing the brightness $B_3$ with the brightness $B_2$ in proportion to the amount of the transition $T_2$ traversed at position $P_2$. The orphan transitions $O_1$ and $O_2$ are then computed accordingly.

Figure 9J:
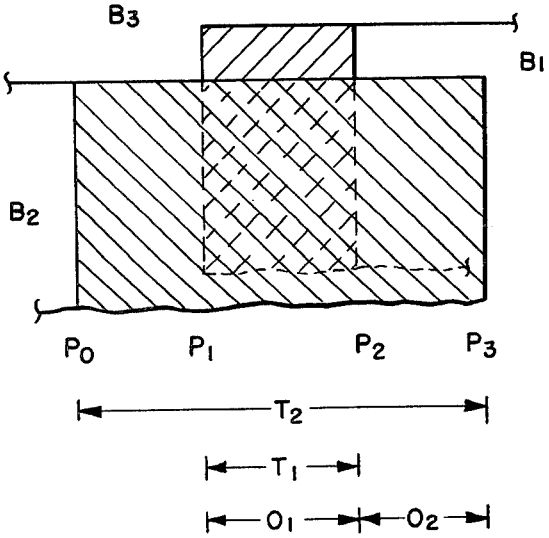

In the overlapping situation of FIG. 9J, the deep transition $T_1$ is a leading transition and the shallow transition $T_2$ is a trailing transition with the transition $T_1$ beginning and ending within the transition $T_2$. The transition $T_2$ goes from position $P_0$ to $P_3$ and the transition $T_1$ goes from position $P_1$ to $P_2$. This overlapping situation is represented by the transition $T_2$ going from a brightness $B_2$ at position $P_0$ to a brightness $B_3$ at position $P_3$ superceded by orphan transition $O_1$ from position $P_1$ to $P_2$ and orphan transition $O_2$ from $P_2$ to $P_3$. The brightness at position $P_1$ is computed by determining the brightness of the transition $T_2$ at position $P_1$ and the brightness at position $P_2$ is computed by mixing the brightness $B_2$ with brightness $B_1$ in proportion with the amount of the transition $T_2$ traversed at $P_2$. The brightnesses determined for positions $P_1$ and $P_2$ are then used to compute the orphan transitions using $B_1$ as the final brightness for the orphan transition $O_2$.

Figure 9K:
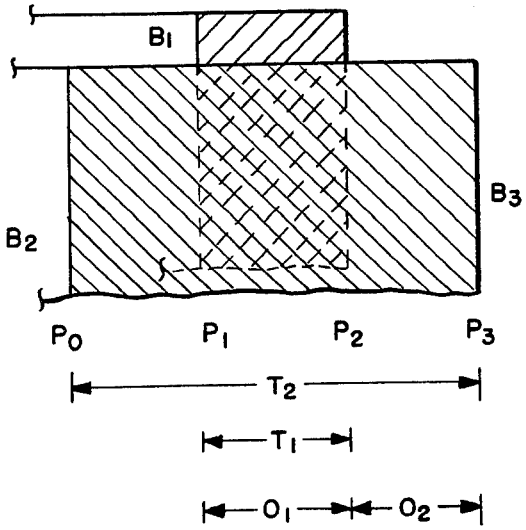

In the situation of FIG. 9K, both transitions are trailing transitions with the deep transition $T_1$ starting and ending within the transition $T_2$. The transition $T_2$ goes from position $P_0$ to $P_3$ and the transition $T_1$ goes from position $P_1$ to $P_2$. This composite transition is represented in the display chain by the transition $T_2$ superceded by orphan transitions $O_1$ from position $P_1$ to $P_2$ and $O_2$ from position $P_2$ to $P_3$. The transition $T_2$ goes from a brightness $B_2$ to the brightness $B_1$. The brightness at the point $P_1$ is computed by determining the brightness of the transition $T_2$ at the position $P_1$ and the brightness at the position $P_2$ is computed by mixing the brightness $B_2$ with the brightness $B_3$ in proportion to the amount of the transition $T_2$ traversed at position $P_2$. The orphan transitions are then computed from these computed brightness levels in the same manner as described above using the brightness $B_3$ as the final brightness for the orphan transition $O_2$.

Figure 10A:
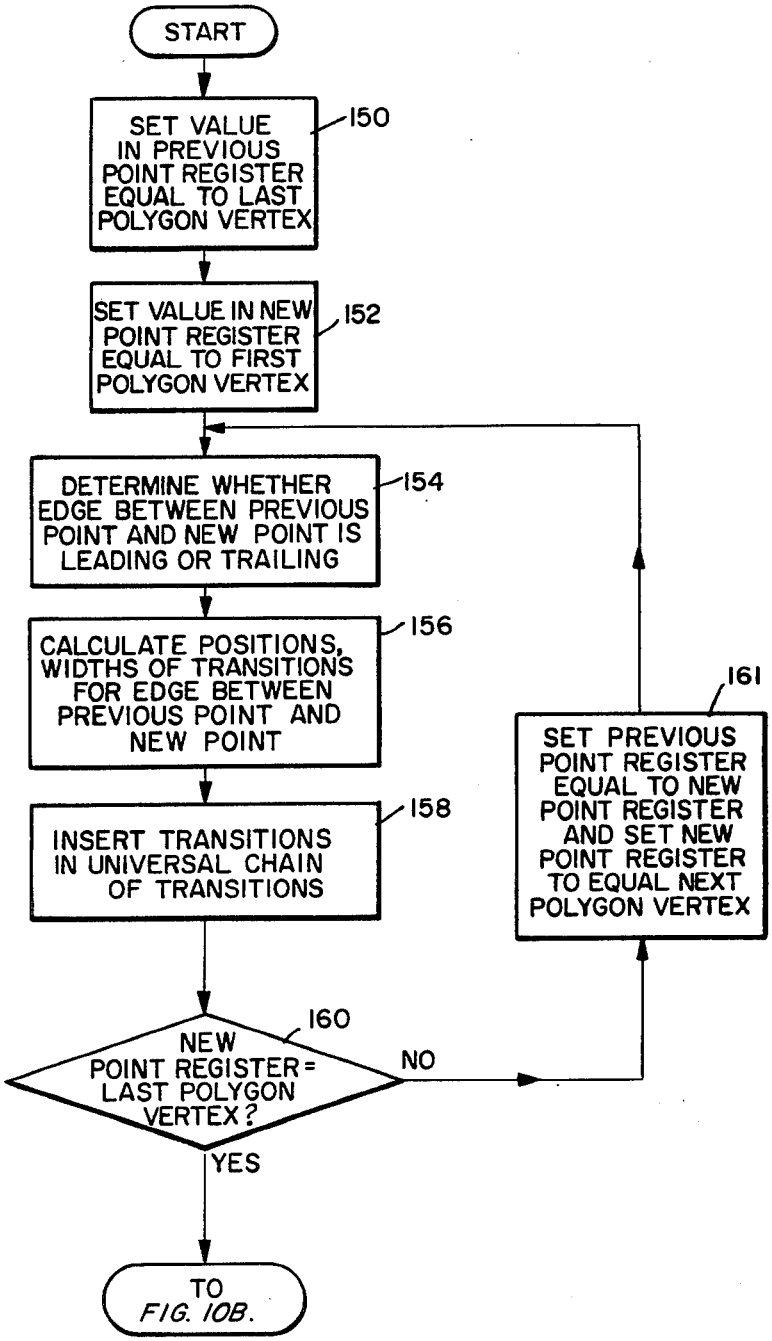
FIGS. 10A and 10B illustrate a flow chart of the program of the present invention for calculating transition specifications to represent a polygon to be displayed by the system of the present invention.
Figure 10B:
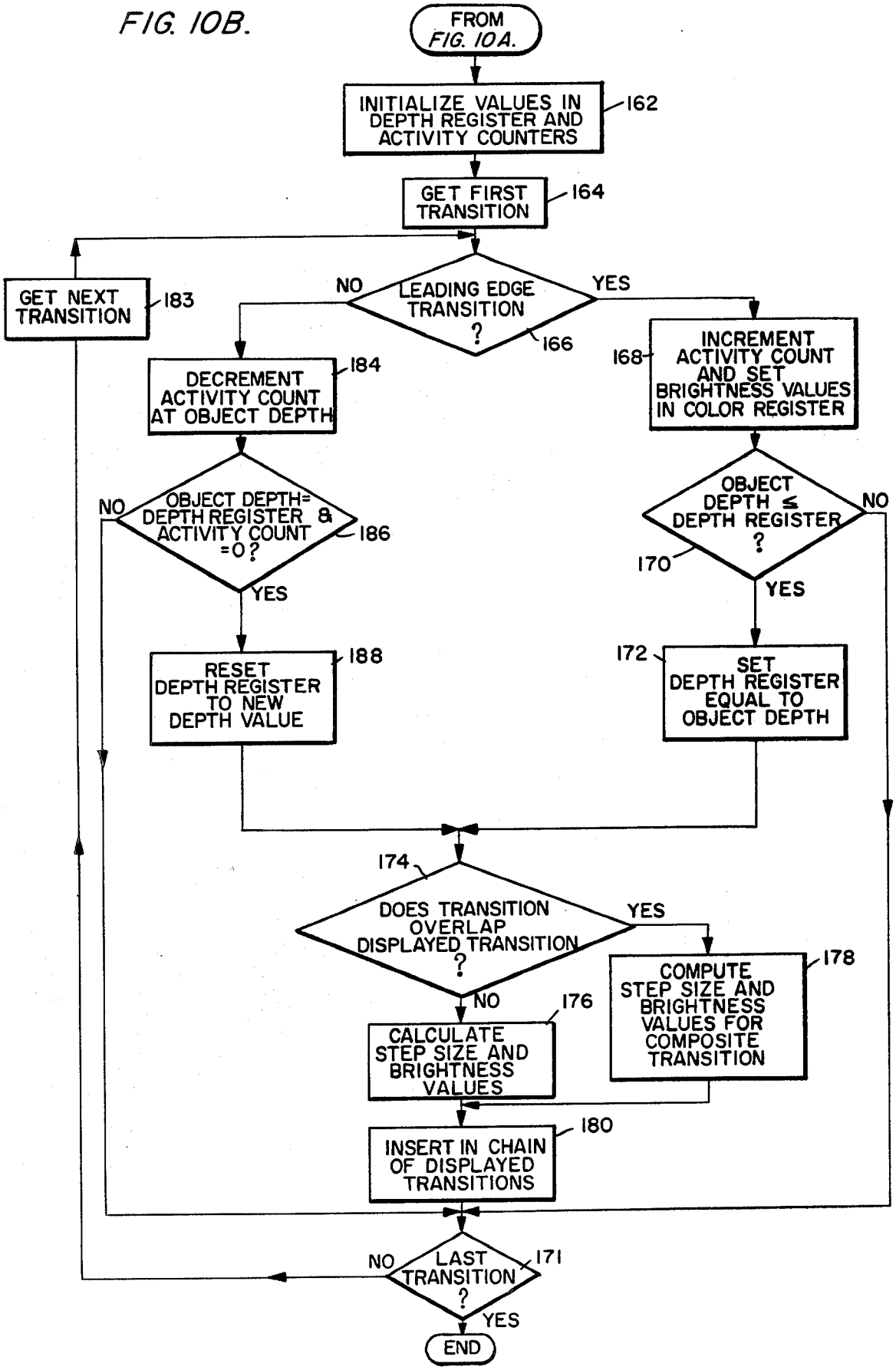

FIGS. 10A and 10B show a flow chart of the software for computing the transition specifications for a polygon. In the portion of the program shown in FIG. 10A, a transition specification is mapped into the display memory for each point where a horizontal scan line crosses the edge of the polygon and the width and the starting position of each of the transitions is computed and stored in the corresponding transition specification. In addition, the transition specifications are inserted in the universal chain of all transition specifications representing object edges (excluding orphan transition specifications) in the display whether such edges are visible or not. The step size and starting and final brightness values are determined in the program portion shown in FIG. 10B and are determined only for those transitions which are visible.

As indicated above, a polygon is specified by identifying the coordinate positions of the vertices of the polygon. These vertices are numbered in sequence proceeding clockwise around the polygon with one vertex being identified as the first vertex and the next counterclockwise vertex being identified as the last vertex. Upon the vertices of the polygon being received or determined by the computer as a polygon to be added to the display, the computer enters into the program illustrated in FIGS. 10A and 10B. In the first instruction sequence 150 of the program, the coordinates of the last polygon vertex are set in a register of the processing computer 15 identified as the previous point register. In the next instruction sequence 152, the coordinates of the first polygon vertex are set in another register of the processing computer 15 identified as the new point register. In the following instruction sequence 154, the computer determines whether or not the edge of the polygon extending between the vertices at the positions represented in the previous point register and the new point register is a leading edge or a trailing edge. This determination is accomplished by determining whether or not the vertex in the previous point register is above or below the vertex in the new point register. In the next instruction sequence 154, the position of each transition is calculated for the edge extending between the vertex in the previous point register and the vertex in the new point register and, in addition, the width of the transitions are calculated in accordance with the formula $8/\tan\theta$ in which $\theta$ is the angle that the scan line makes with the edge. In this instruction sequence, the transition specifications defining the edge between the points represented in the previous point and next point registers are mapped into the display memory and the width information and the position information are stored in the transition specifications along with an indication of whether or not the edge is a leading or trailing edge. In addition, the depth of the object for the transition is stored in each of the transition specifications and the color of the object in terms of the three color brightness levels is stored in the transition specification.

In instruction sequence 158, the new transition specifications are inserted in the universal chain of all object edge transition specifications in the display (excluding orphans). This is accomplished by updating the universal linked list of addresses; that is, by finding the previous transition in the raster scan sequence and changing the universal linking address in this previous transition specification to point the transition specification being inserted and the universal linking address in the new transition specification to point to the following transition specification in the raster scan sequence. Following instruction sequence 158, the program enters decision instruction sequence 160. In this instruction sequence, the computer determines whether the vertex in the new point register is identified as the last polygon vertex. If it is not, then the program proceeds into instruction sequence 161.

In instruction sequence 161, the coordinates in the previous point register are set equal to the coordinates which were in the new point register and the coordinates in the new point register are set to equal the coordinates of the next polygon vertex in the numbered sequence following the one which had been in the new point register. The coordinates in the previous point register and the new point register will then define the next edge proceeding around the polygon. The instruction sequences 154, 156 and 158 are then repeated to compute the transition widths and positions for this next polygon edge. The process continues to iterate through instruction sequences 154, 156 and 158 until the last edge has been calculated whereupon the vertex in the new point register will be the last polygon vertex and the program will proceed into FIG. 10B.

In the portion of the program of FIG. 10B, the beginning and final brightness levels of the new transition specifications are determined and the step sizes are calculated. In addition, all of the transition specifications which occur on any affected scan line (that is, a scan line on which a new transition has been added by the process of FIG. 10A) are examined to see if they are visible and, if so, their beginning and final brightness levels are redetermined and their step sizes are recalculated. It will be understood that the calculation routine of FIG. 10B must be carried out separately for both the condition of blinking objects on and for blinking objects off, but for purposes of simplication, the program is described for only one of these conditions.

In the calculation routine of FIG. 10B, the values in certain registers in the computer are initialized. One of these registers referred to as the depth register is intended to indicate the current visible depth in the display at the transition specification currently being calculated. In the initialization of this depth register, the value set therein is the background depth of the display which is the deepest depth in the display behind all of the 8 depths at which an object can be located. In addition, counters are provided, one corresponding to each of the 8 depths at which objects can be located in the display. These counters, which are referred to as activity counters, are each intended to contain a count of zero if no object is displayed at the corresponding depth immediately following the transition which is being calculated or recalculated and contain a count of one if an object is displayed at the corresponding depth. If the operator, or the computer itself, erroneously directs that more than one object be displayed at the same location at the same depth, then the corresponding activity counter will contain a corresponding count of more than one. These activity counters are all set to zero in the initialization sequence 162. In addition, a color register is provided for each of the 8 depths, each color register being associated with the activity counter for that depth. The color registers are intended to contain the brightness levels of the three colors of any object in the display at that depth. Further, initialization sequence 162 removes any orphan transitions previously created on any affected scan line.

Following the initialization sequence 162, the program proceeds into instruction sequence 164 wherein the transition specification for the first transition on an affected scan line is obtained. The program then proceeds into decision sequence 166 where the program branches to instruction sequence 168 if the transition specification indicates that it is for a leading edge transition. In instruction sequence 168, the count is incremented in the activity counter corresponding to the depth of the object for the transition specification being currently calculated. In addition, brightness values of the object are set into the color register corresponding to this depth.

Following instruction sequence 168, the program proceeds to the decision sequence 170 in which it is determined whether the object depth of the current transition is less than or equal to the depth in the depth register. If transition is visible, the object depth will be less than or equal to the depth currently in the depth register. If the value in the depth register were greater than the transaction object depth, this would mean that the new transition is hidden behind another displayed object and the program would branch to decision sequence 171. When the transition is visible, the program proceeds into instruction sequence 172 where a value is set into the depth register corresponding to the object depth of the current transition specification being calculated.

After instruction sequence 172, the program proceeds into a decision sequence 174 wherein it is determined whether or not the transition currently being calculated overlaps another displayed transition. If it does not, the program proceeds into instruction sequence 176 where the step size and final brightness are determined and inserted into the transition specification. The instruction sequence 174 actually determines whether or not an overlapping situation corresponding to any of FIGS. 9A–9K exist as there are some overlapping situations (not shown in FIGS. 9A–9K) in which the deep transition is not visible and these overlapping situations can be treated the same as adjacent transitions which are not overlapping. If it is determined that the transition is involved in one of the overlapping situations of FIGS. 9A–9K, then the program proceeds into instruction sequence 178 wherein the step size and brightness values are computed for each of the transitions of the composite transition representing the overlapping situation including any necessary orphan transitions. In this instruction sequence, the orphan transition specifications are mapped into the display memory.

Following completion of instruction sequence 176 or 178, the program proceeds into instruction sequence 180 wherein the calculated transition or transitions are inserted in the displayed chain of transitions by correcting the display linking address of the previous transition specification for the displayed chain of transitions and setting the display linking address in the current transition specification to point to the next transition specification in the displayed sequence.

Following completion of instruction sequence 180, the program proceeds into the decision sequence 171. In decision sequence 171, the program determines whether or not the transition specification just calculated was the last transition specification in the affected horizontal scan lines. If the transition specification is not the last transition specification, the program branches to instruction sequence 183 wherein the program gets the next transition specification in the raster scan on the affected scan lines and then proceeds again into decision sequence 166. If decision sequence 166 determines that this next transition specification is another leading edge transition, then the program again branches into instruction sequence 168 and the program repeats as described above. On the other hand, if it is determined that the new transition specification is a trailing edge, then the program branches into instruction sequence 184 wherein the count in the activity counter corresponding to the depth of the object of the transition specification is decremented. This action should change the count in the activity counter to zero provided not more than one object has been called for to be displayed at this depth and at this location.

Following instruction sequence 184, the program proceeds into decision sequence 186 wherein it is determined whether or not the count in the activity counter for the depth of the object of the current transition specification is zero and also whether or not the depth of the object of the current transition specification is equal to the depth in the depth register. If the activity count is not zero, as it should be, then the system is designed not to display this trailing edge transition and, accordingly, the program will branch to the decision sequence 171. Similarly, if the object depth of the current transition specification does not equal the depth in the depth register, this means that there is an object at a shallower depth at this location on the scan line and, accordingly, the transition is not a displayed transition. Under these circumstances, the program also branches to decision sequence 171. If the count in the activity counter for the depth of the object of the current transition specification is equal to zero and the depth in the depth register is equal to the depth of the object of the current transition specification, then the transition is to be displayed and the program proceeds from decision sequence 186 into instruction sequence 188. In instruction sequence 188, the value in the depth register is set to the depth of any object to be displayed immediately following the current trailing edge transition being calculated and if no object is to be displayed, then the depth register is to represent the background depth of the display. The value to set in the depth register is determined by examining the activity counters. If, following the trailing edge transition, the display goes to the display of a deeper object behind the currently displayed object, then the activity counter for the depth of the deeper object would have a count of one or greater. If no activity counters have a count of one or greater, then the depth will be that the background of the display. If two or more activity counters have a count of one or greater, then the value set in the depth register corresponds to the depth of that activity counter which corresponds to the shallowest depth among the activity counters which have counts of one or greater. In this manner, the value in the depth register is set to represent the depth of the displayed object beyond the trailing edge transition currently being calculated on a given scan line. The program then proceeds into decision sequence 174 and the step size and brightness are computed in instruction sequences 176 or 178 and inserted in the displayed chain of transitions in instruction sequence 180 in the same manner as described above.

If, in decision sequence 171, it is determined that the transition specification represents the last transition on the affected scan lines, then the transition specification calculations have been completed and the program ends.

The above description has been described for a polygon. The same program will be used to calculate the transition specifications for a straight line by considering the straight line to have a width and thus conform to a rectangular polygon. The vertices of the polygon, which are the corners of the rectangle comprising the line, are calculated by the computer from the specification of the positions of the ends of the line and the width of the line and the program of FIG. 10A and FIG. 10B then uses these calculated vertices to compute the transition specifications to define the line. The transition specifications for characters are calculated in an analogous manner.

In the system as described above, the width of the transition in brightness and colors as the electron beam passes over the edge of an object being displayed is made proportional to the cotangent of the angle that the raster scan line makes with the edge and the change in brightness and color is stepped gradually from the beginning brightness and color before the edge to the final brightness and color after the edge. In addition, the transitions are centered with high precision on the edges which are represented by the transitions. As a result, the system of the present invention generates video signals which approximate the analog signals that would be made by a video camera focusing on the objects being displayed and the staircase distortion caused by aliasing is substantially minimized.

In the above described system, the software operating on the input data and storing the transition specifications calculates and stores values representing the width of the transition values representing the starting position of the transitions, and values representing the amounts that the intensity is to be increased on each step within the transition. However, instead of storing all of this data, each transition specification could merely store signals representing the position of the transition, the final brightness, and the angle that the horizontal scan line makes with each edge and the control of the transition width, position, intensity change in response to this stored information could be carried out by the display circuitry.

The preferred embodiment of the present invention has been described as a color display device. It will be appreciated that the invention, however, is equally applicable to monochromatic displays. Likewise, line counts other than 525 and horizontal increments different than 4096 could be used.

Many other modifications may be made to the above described specific embodiment of the invention without departing from the spirit and scope of the invention, which is defined in the appended claims.

What is claimed is:

1. A display system comprising video display means for generating a display by means of a raster scan, encoding means responsive to input signals representing objects to be displayed by said video display means within said raster scan to store simultaneously a set of transition specifications representing each point on the objects to be displayed where the raster scan of said video display means crosses the edge of an object to be displayed, said transition specitications containing digital data identifying the positions of each said point and each of said transition specifications containing digital data varying in accordance with the slope that the edge of the object makes with the raster scan at the point represented by such transition specification, display creation means responsive to the stored transition specifications to generate a video signal and apply such video signal to said video display means to cause said video display means to display the objects represented by said input signals, said display creation means causing the video signal to undergo transitions in intensity, one corresponding to each of said transition specifications, at the locations within said raster scan corresponding to said positions represented in said transition specifications, with the width of each transition varying in accordance with the digital data varying with the slope in the corresponding transition specification.

2. A display system as recited in claim 1, wherein said data varying in accordance with the slope that the object edge makes with the raster scan line comprises data indicating the width of the transition to be generated by said display creation means in response to such transition specification.

3. A display system as recited in claim 1, wherein each of said transition specifications identifies the rate that the video intensity is to be increased in the transition and wherein said display creation means changes the intensity of said video signal in steps with magnitudes and spacings to correspond with the rate identified in the corresponding transition specification.

4. A display system as recited in claim 3, wherein each of said transition specifications contain digital data representing the final intensity to which the video signal is being changed and wherein said display creation means changes the intensity of the video signal in each transition to the final intensity as represented in the digital data of the corresponding transition specification at the end of the transition.

5. A display system as recited in claim 1, wherein said transition specifications and said display creation means comprise means to cause the transition for each transition specification to start at a location on said raster scan at a position displaced in said raster scan ahead of the point represented by such transition specification by about one-half the width of the transition represented by such transition specification.

6. A display system as recited in claim 5, wherein each transition specification contains data indicating the starting position of the corresponding transition in said raster scan.

7. A display system comprising video display means generating a display by means of a raster scan, storage means to store transition specifications representing corresponding transitions in video brightness at each point on an object to be displayed where the raster scan of said video display means crosses the edge of the object to be displayed, said transition specifications each containing (1) data identifying the starting position of a predetermined transition in said raster scan, (2) data representing the width of the corresponding transition, and (3) data representing the rate of change in brightness in the corresponding transition, display creation means to read said transition specifications out in the order that they occur in said raster scan and to generate a video signal in accordance with said transition specifications and to apply said video signal to said video display means to cause said video display means to display the object represented by said transition specifications, said display creation means comprising a register for containing a digital value representing video brightness, digital-to-analog converting means to generate said video signal from the value stored in said register, and means to change the value in said register for each of said transition specifications read out by said display creation means beginning at the starting position identified in a predetermined one of said transition specifications and changing the value in said register in steps having amplitudes and spacings corresponding to said rate of change in brightness in the transition specification read out by said display creation means.

8. A display system as recited in claim 7, wherein each of said transition specifications contain data representing the final value for the video brightness at the end of the corresponding transition and wherein said means to change the value in said register changes the value in said register for each transition specification read out by said display creation means to the final brightness value indicated by the data in the corresponding transition specification.

9. A method of displaying a plurality of objects in a video display device generating a display by means of a raster scan comprising (1) changing the displayed brightness on the video display device in transitions of brightness at each point in the raster scan where the raster scan crosses the edge of an object to be displayed, with the transitions each having a width corresponding to the slope that the raster scan line makes with the edge at the transition in those instances in the display wherein such transitions representing adjacent or coextensive edges of different objects do not overlap, and (2) in those instances wherein transitions having widths varying in accordance with the slope of the corresponding edges would overlap, changing the brightness of the display in a composite transition to represent both such edges with the brightness being changed at one rate during part of the composite transition and being changed at a different rage in another part of said transition.

10. A video display system comprising a video display means generating a display by means of a raster scan, encoding means responsive to input signals representing objects to be displayed by said video display means to store transition specifications representing each point on the objects to be displayed where the raster scan of said video display means crosses the edge of an object to be displayed, said objects to be displayed including one or more blinking objects, said transition specifications including a first set of transition specifications representing these edge points which are visible when the blinking objects are on and a second set of transition specifications representing those edge points which are visible when the blinking objects are off, the blinking objects obscuring object portions in the display which are not visible when the blinking objects are on and which are visible when the blinking objects are off, display creation means responsive to the stored transition specifications to generate a video signal and apply such video signal to the video display means to cause said video display means to display the objects represented by the first set of transition specifications during spaced time intervals and at alternate time intervals to display the objects represented by said second set of transition specifications whereby the object portions obscured by the blinking objects are not visible when the blinking objects are on and are visible when the blinking objects are off.

11. A display system comprising video display means for generating a display by means of scan lines, encoding means responsive to input signals representing objects to be displayed by said video display means to store transition specifications each corresponding to a point on the objects to be displayed where one of said scan lines meets the edge of an object to be displayed, said transition specifications containing digital data identifying the positions of each said point, display creation means response to the transition specifications to generate a video signal and apply such video signal to said video display means to cause said video display means to display the objects represented by said input signals, said display creation means causing the video signal to undergo transitions in intensity at each said point in the display, each of said transition specifications identifying the rate that the video intensity is to be changed in the transition and identifying the width of the transition at the corresponding point, said display creation means changing the intensity of said video signal in each transition in steps with magnitudes and spacings to correspond with the rate identified in the corresponding transition specification across a width corresponding to the width identified in the corresponding transition specification.

12. A display system as recited in claim 11 wherein each of said transition specifications contain digital data representing the final intensity to which the video signal is being changed and wherein the display creation means changes the intensity of the video signal in each transition to the final intensity as represented by the digital data in the corresponding transition specification at the end of the transition.

13. A video display system comprising video display means for generating a display by means of scan lines, encoding means responsive to input signals representing objects to be displayed by said video display means to store transition specifications each corresponding to a point on the object to be displayed where one of said scan lines meets the edge of an object to be displayed, each transition specifications containing digital data varying in accordance with the slope that the edge of the object makes with the scan line at the corresponding point and data to determine the final intensity of the display at the end of the transition, display creation means responsive to the transition specifications to generate a video signal and apply such video signal to said video display means to cause said video display means to display the objects represented by said input signals, said display creation means causing the video signal to undergo transitions in intensity at locations in the display corresponding to the positions of each said point with the width of each transition varying in accordance with slope that the object edge makes with the raster scan at the point corresponding to such transition specification as represented by the digital data in the corresponding transition specification, said display creation means changing the intensity of said video signal in each transition to the final intensity as represented in the digital data in the corresponding transition specification.

* * * * *

UNITED STATES PATENT AND TRADEMARK OFFICE

CERTIFICATE OF CORRECTION

PATENT NO. : 4,482,893

DATED : November 13, 1984

INVENTOR(S) : Steven D. Edelson

It is certified that error appears in the above-identified patent and that said Letters Patent is hereby corrected as shown below:

Column 6, line 40, change "generate" to --generated--.

Column 21, line 67, change "rage" to --rate--.

Column 22, line 11, change "these" to --those--.

Signed and Sealed this

*Seventeenth* Day of *December 1985*

[SEAL]

*Attest:*

DONALD J. QUIGG

*Attesting Officer*

*Commissioner of Patents and Trademarks*